US006644958B1

(12) United States Patent
Li

(10) Patent No.: US 6,644,958 B1
(45) Date of Patent: Nov. 11, 2003

(54) BARBECUE LIGHTER WITH SAFETY ARRANGEMENT

(76) Inventor: Kin Chung Li, 2211 S. Hacienda Blvd., Suite 107, Hacienda Heights, CA (US) 91754

( * ) Notice: Subject to any disclaimer, the term of this patent is extended or adjusted under 35 U.S.C. 154(b) by 0 days.

(21) Appl. No.: 10/138,820

(22) Filed: May 6, 2002

(51) Int. Cl.[7] ..... F23D 11/36; F23Q 7/12
(52) U.S. Cl. ..... 431/153; 431/255
(58) Field of Search ..... 431/153, 255, 431/344, 345

(56) References Cited

U.S. PATENT DOCUMENTS 6,010,328 A * 1/2000 Sung ..... 431/153
6,086,358 A * 7/2000 Potskhishvili et al. ..... 431/153
6,129,544 A * 10/2000 Chen ..... 431/153
6,200,130 B1 * 3/2001 Man ..... 431/153
6,217,313 B1 * 4/2001 Luo ..... 431/153
6,428,309 B1 * 8/2002 Doiron ..... 431/153
2002/0177091 A1 * 11/2002 Chen ..... 431/153

* cited by examiner

*Primary Examiner*—Alfred Basichas
(74) *Attorney, Agent, or Firm*—Raymond Y. Chan; David and Raymond Patent Group

(57) ABSTRACT

A barbecue lighter incorporates with a safety arrangement which includes an actuating member including a pusher arm disposed in a trigger cavity of the barbecue lighter in a movable manner, and a resilient element disposed between the pusher arm and an ignition trigger for applying an urging pressure against the pusher arm so as to normally retain the pusher arm in a safety position. In the safety position, the pusher arm is positioned away from a depressible end of a gas lever with a predetermined distance. To ignite the barbecue lighter, the pusher arm is required to move to a position that when the ignition trigger is depressed downwardly, the pusher arm is driven downwardly to depress the depressible end of the gas lever for releasing gas, so as to ignite the barbecue lighter.

9 Claims, 6 Drawing Sheets

BARBECUE LIGHTER WITH SAFETY ARRANGEMENT

BACKGROUND OF THE PRESENT INVENTION

1. Field of Invention

The present invention relates to a barbecue lighter, and more particularly to a barbecue lighter with a safety arrangement, the depression of the ignition trigger of the barbecue lighter normally cannot drive the depressible end of the gas lever downwardly for releasing gas. Therefore, no emitted gas is released and ignited so as to prevent the barbecue lighter from being ignited accidentally or by children.

2. Description of Related Arts

A barbecue lighter is commonly used at home such as pilot light for stoves or outdoor activities such as fireplaces or camping since the barbecue lighter can provide a father ignition distance comparing with an ordinary lighter.

A conventional barbecue lighter comprises a casing having a liquefied gas storage, a gas emitting nozzle extended from the liquefied gas storage for controlling a flow of gas, and an elongated nozzle tube extended from the casing for encircling the gas emitting nozzle. Due to the ignition operation of the barbecue lighter, the barbecue lighter usually incorporates with a piezoelectric unit in such a manner that when the trigger button is depressed downwardly to compress the piezoelectric unit and to release the gas from the liquefied gas at the same time, the sparks produced by the piezoelectric unit will ignite the emitted gas from the gas emitting nozzle.

For safety reasons, both the government and the consumers in United States demand a safety device employed in every lighter, including the barbecue lighter, to prevent unwanted ignition accidentally or by a child. One of the most common ways to incorporate the barbecue lighter with the safety device is to lock up the trigger button in a downwardly movable manner, so as to prevent the trigger button from being pressed downwardly to ignite the barbecue lighter. However, the operation of such safety device is unreliable.

Since the downward movement of the trigger button is locked up in the locking position, once the trigger button can be depressed downwardly, the barbecue lighter will be ignited. In other words, the child may easily to figure out how to unlock the barbecue lighter.

In order to stop the child from the usage of the barbecue lighter, a complicated safety device must be used, such as requiring a double-action operation to ignite the barbecue lighter. However, this adverse result affects the ease of operating the safety device and leads to different operational results depending on the users. Moreover, such safety device will highly increase the manufacturing cost of the barbecue lighter. Therefore, such safety device can be considered disadvantageous in practical use.

SUMMARY OF THE PRESENT INVENTION

A main object of the present invention is to provide a barbecue lighter with a safety arrangement, wherein the depression of the ignition trigger of the barbecue lighter normally cannot drive the depressible end of the gas lever downwardly for releasing gas. Therefore, no emitted gas is released and ignited so as to prevent the barbecue lighter from being ignited accidentally or by children.

Another object of the present invention is to provide a barbecue lighter with a safety arrangement, wherein in order to ignite the barbecue lighter, the user must require to move a pusher arm of the safety arrangement to a position that the bottom portion of the pusher arm is positioned right above the depressible end of the gas lever and then depress the ignition trigger. Therefore, no gas is released when only depressing the ignition trigger, so as to prevent the barbecue lighter from being ignited accidentally or by children.

Another object of the present invention is to provide a barbecue lighter with a safety arrangement, wherein the ignition of the barbecue lighter of the present invention requires a simple single-action operation by an adult's finger instead of the conventional double-action operation.

Another object of the present invention is to provide a barbecue lighter with a safety arrangement, wherein the safety arrangement does not require to alter the original structural design of the barbecue lighter, so as to minimize the manufacturing cost of incorporating the safety arrangement with every conventional barbecue lighter having an ignition trigger.

Accordingly, in order to accomplish the above objects, the present invention provides a barbecue lighter, comprising:

- a casing having a liquefied gas cavity and a trigger cavity provided therein;
- a gas emitting nozzle extended from and communicated with the liquefied gas cavity via a gas releasable valve;
- an elongated nozzle tube mounting on a ceiling of the casing for encircling the gas emitting nozzle;
- a gas lever, which is pivotally supported in the casing, having a lifting end engaged with the gas releasable valve and a depressible end arranged in such a manner that when the depressible end of the gas lever is depressed, the lifting end of the gas lever lifts up the gas releasable valve for releasing gas from the liquefied gas cavity;
- a piezoelectric unit, which is disposed in the trigger cavity of the casing, having an ignition tip extended adjacent to the gas emitting nozzle;
- an ignition trigger, which is disposed in the trigger cavity of the casing in a vertically movable manner, being attached on a top portion of the piezoelectric unit; and
- a safety arrangement, which comprises an actuating member comprising a pusher arm disposed in the trigger cavity in a movable manner, and a resilient element disposed between the pusher arm and the ignition trigger for applying an urging pressure against the pusher arm so as to normally retain the pusher arm in a safety position, wherein in the safety position, the pusher arm is positioned away from the depressible end of the gas lever with a predetermined distance, and in an ignition position, the pusher arm is moved to a position that when the ignition trigger is depressed downwardly, the pusher arm is driven downwardly to depress the depressible end of the gas lever for releasing gas, so as to ignite the barbecue lighter.

To ignite the barbecue lighter, the pusher arm is required to operate to the ignition position by moving the pusher arm toward the depressible end of the gas lever, so that the ignition trigger is slid downwardly to drive the pusher arm downward so as to depress depressible end of the gas lever for releasing gas. At the same time, the piezoelectric unit is depressed to generate sparks to ignite the gas emitted from the gas emitting nozzle of the barbecue lighter.

DETAILED DESCRIPTION OF THE PREFERRED EMBODIMENT

Figure 1:
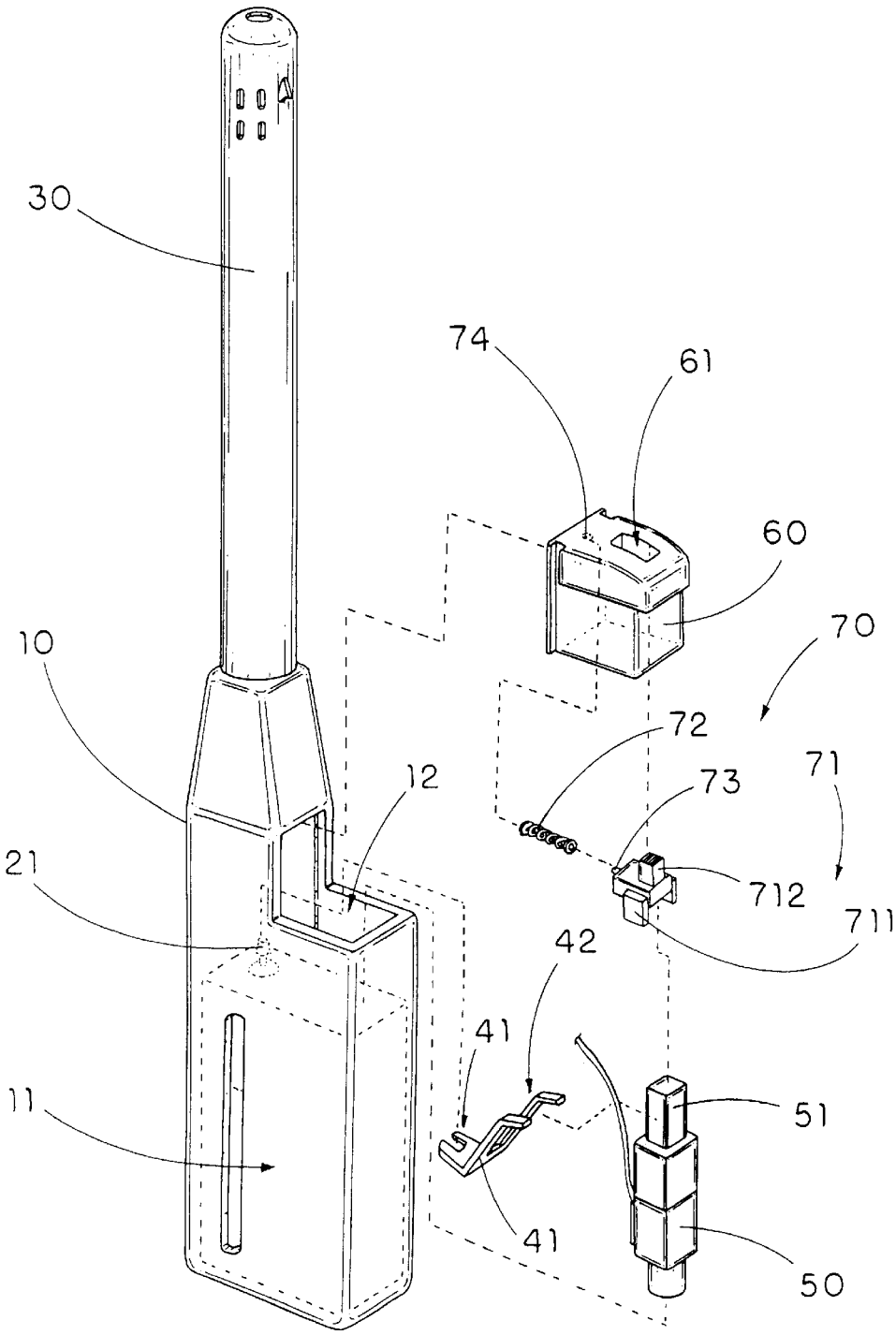
FIG. 1 is a perspective view of a barbecue lighter with a safety arrangement according to a first preferred embodiment of the present invention.
Figure 2:
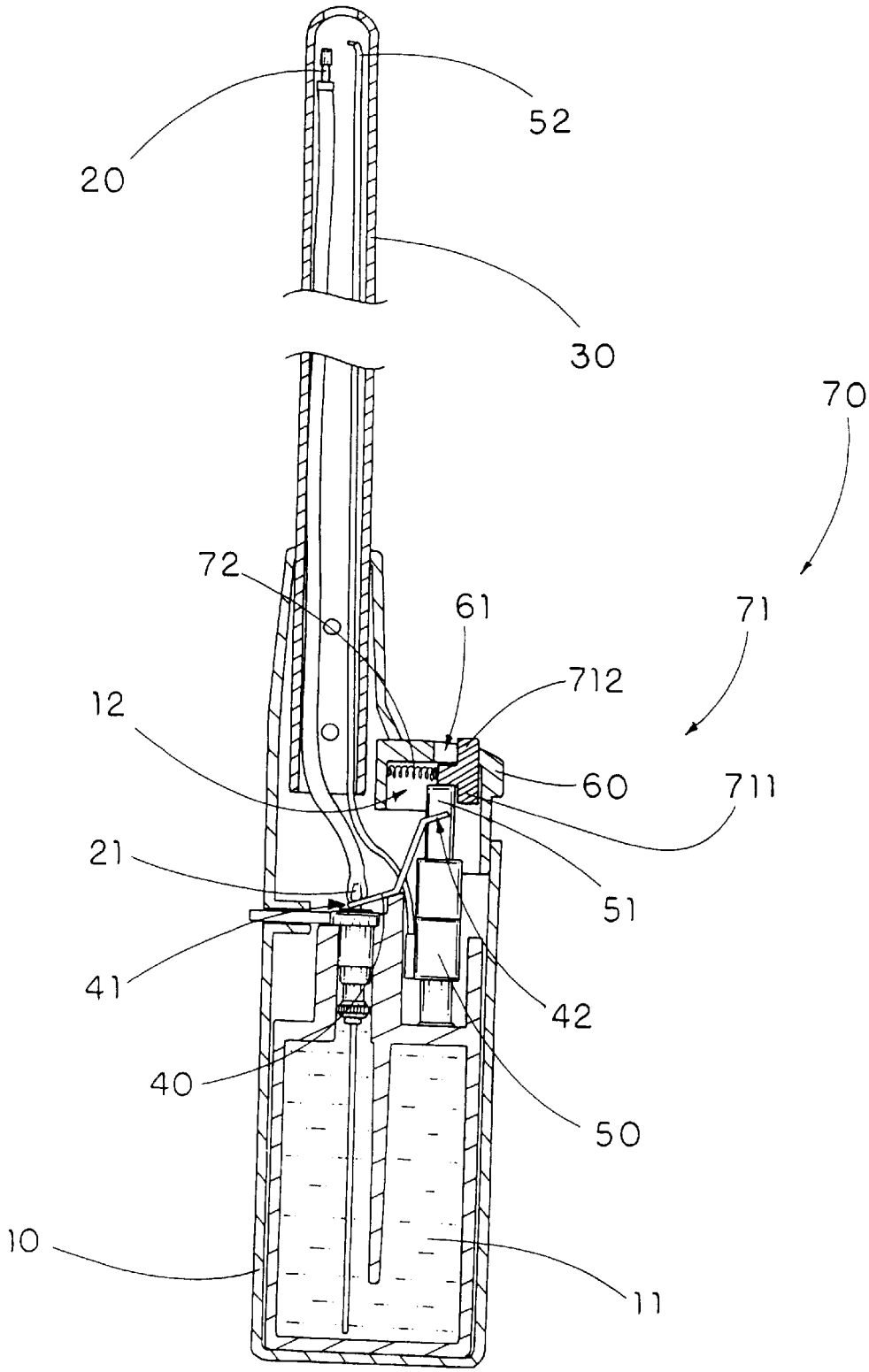
FIG. 2 is a sectional view of the safety arrangement of the barbecue lighter in a safety position according to the above first preferred embodiment of the present invention.

Referring to FIGS. 1 and 2 of the drawings, a barbecue lighter according to a first preferred embodiment of the present invention is illustrated, wherein the barbecue lighter, such as a standard barbecue lighter, comprises a casing 10 having a liquefied gas cavity 11 and a trigger cavity 12 provided therein, a gas emitting nozzle 20 extended from and communicated with the liquefied gas cavity 11 via a gas releasable valve 21, and an elongated nozzle tube 31 mounting on a ceiling of the casing 10 for encircling the gas emitting nozzle 20.

A gas lever 40, which is pivotally supported in the casing 10, has a lifting end 41 engaged with the gas releasable valve 21 and a depressible end 42 arranged in such a manner that when the depressible end 42 of the gas lever 40 is depressed, the lifting end 41 of the gas lever 40 lifts up the gas releasable valve 21 for releasing gas from the liquefied gas cavity 11.

A piezoelectric unit 50, which is disposed in the trigger cavity 12 of the casing 10, has an ignition tip 52 extended adjacent to the gas emitting nozzle 20. The piezoelectric unit 50 further has a movable operating part 51 extended upwardly and arranged in such a manner when the movable operating part 51 is depressed downwardly, the ignition tip 52 generates sparks to ignite the gas emitted from the gas emitting nozzle 20.

An ignition trigger 60, which is disposed in the trigger cavity 12 of the casing 10 in a vertically movable manner, is attached on a top portion of the piezoelectric unit 50 wherein when the ignition trigger 60 is pushed downwardly, the movable operating part 51 of the piezoelectric unit 50 is depressed. The ignition trigger 60 further has an operation slot 61 provided thereon for communicating the trigger cavity 12 with outside.

The barbecue lighter further comprises a safety arrangement 70 which comprises an actuating member 71 and a resilient element 72, wherein the actuating member 71 comprises a pusher arm 711 disposed in the trigger cavity 12 in a movable manner, and the resilient element 72 is disposed between the pusher arm 711 and the ignition trigger 60 for applying an urging pressure against the pusher arm 711 so as to normally retain the pusher arm 711 in a safety position. In which, in the safety position, the pusher arm 711 is positioned away from the depressible end 42 of the gas lever 40 with a predetermined distance, and in an ignition position, the pusher arm 711 is moved to a position that when the ignition trigger 60 is depressed downwardly, the pusher arm 711 is driven downwardly to depress the depressible end 42 of the gas lever 40 for releasing gas, so as to ignite the barbecue lighter.

According to the preferred embodiment, the pusher arm 711 is downwardly extended into the trigger cavity 12, wherein a bottom portion of the pusher arm 711 functions as a pusher head adapted to depress the depressible end 42 of the gas lever 40 for releasing gas at the ignition position. In the ignition position, the pusher arm 711 is moved to a position that the bottom portion thereof is positioned above the depressible end 42 of the gas lever 40 to depress the depressible end 42 of the gas lever 40 when the ignition trigger 60 is depressed downwardly.

Figure 3:
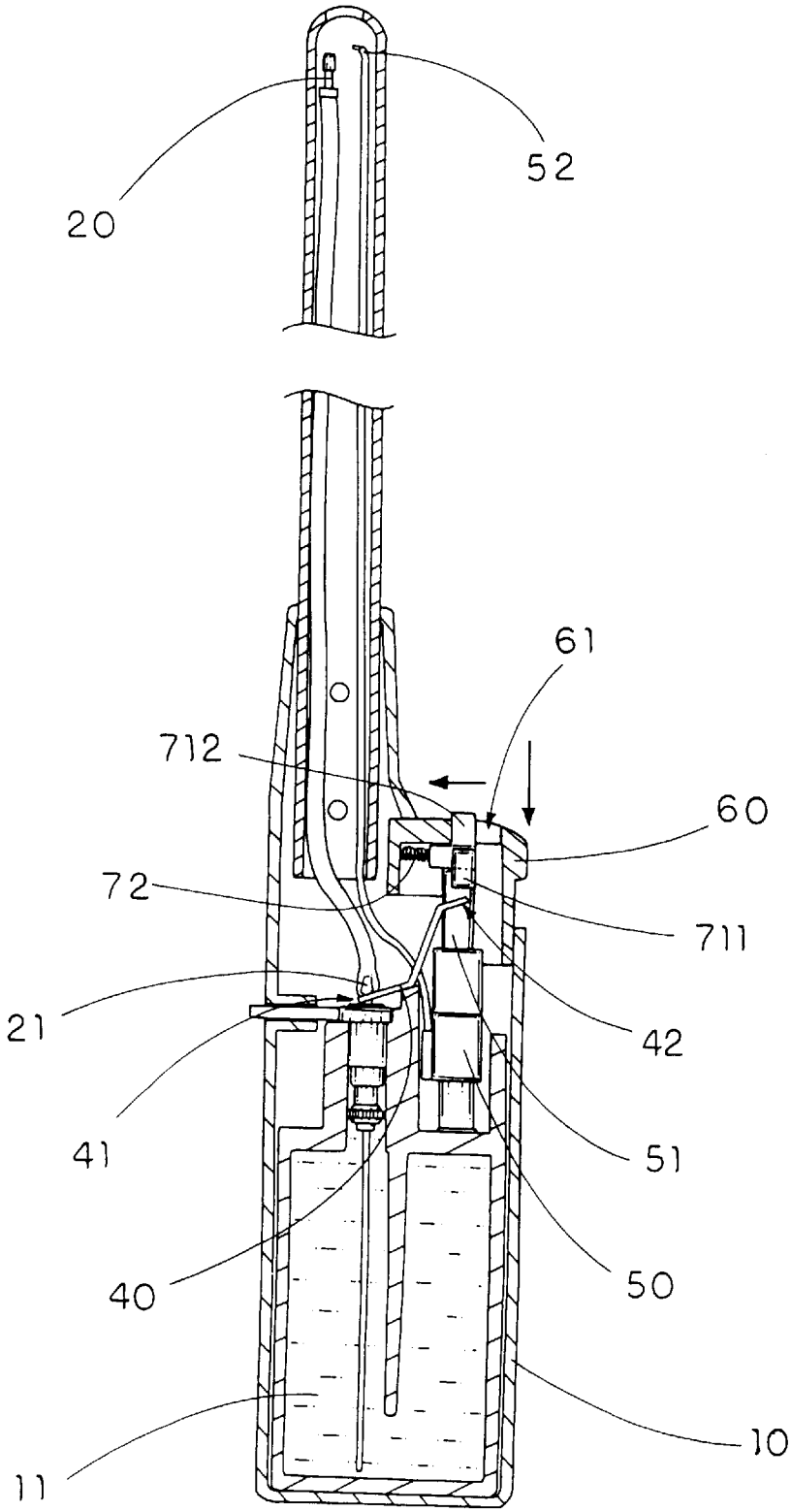
FIG. 3 is a sectional view of the safety arrangement of the barbecue lighter in an ignition position according to the above first preferred embodiment of the present invention.

The actuating member 71 further comprises an operation button 712 extended from the pusher arm 711 to outside through the operation slot 61, wherein the pusher arm 711 is movably disposed in the trigger cavity 12 in such a manner that the pusher arm 711 is arranged to be driven by the operation button 712 to move from the normally safety position, as shown in FIG. 2, to the ignition position, as shown in FIG. 3.

Accordingly, the operation slot 61 is formed on a top wall of the ignition trigger 60 wherein an upper portion of the pusher arm 711 is extended out of the trigger cavity 12 through the operation slot 61 to form the operation button 712. As shown in FIG. 2, an upper portion of the pusher arm 711 is extended out of the trigger cavity 12 through the operation slot 61 to form the operation button 712, wherein the upper portion of the pusher arm 711 is arranged to move a bottom portion thereof above the depressible end 42 of the gas lever 40 at the ignition position.

As shown in FIG. 2, in the safety position, the bottom portion of the pusher arm 711 is positioned away from the depressible end 42 of the gas lever 40 with a predetermined distance in such a manner that when the ignition trigger 60 is depressed downwardly to drive the pusher arm 711 downward, the position of the gas lever 40 is remained unchanged, so that no gas is released to the gas emitting nozzle 20.

In the ignition position, as shown in FIG. 3, the pusher arm 711 is moved at a position that the bottom portion thereof is positioned above the depressible end 42 of the gas lever 40 in such a manner that when the ignition trigger 60 is depressed downwardly to drive the pusher arm 711 downward, the depressible end 42 of the gas lever 40 is depressed downwardly by the pusher arm 711 for releasing gas.

Therefore, in the safety position, even though the ignition trigger 60 is adapted to be pressed downwardly to compress the piezoelectric unit 50, the barbecue lighter cannot be ignited since no gas is released. In other words, the safety arrangement 70 can prevent the barbecue lighter from being ignited accidentally or by children.

The resilient element 72, according to the preferred embodiment, is a compression spring disposed in the trigger cavity 12 for applying an urging pressure against the pusher arm 711 so as to normally retain the pusher arm 711 at the safety position. As shown FIG. 2, the resilient element 72 is provided between the pusher arm 711 and an inner wall of the ignition trigger 60. The resilient element 72 has two ends biasing against the pusher arm 711 and the inner wall of the ignition trigger 60 in such a manner that the resilient element 72 normally urges and retains the pusher arm 711 in a rearward position that the bottom portion of the pusher arm 711 is misalign with the depressible end 42 of the gas lever 40 to prevent the gas released by the gas lever 40 when the ignition trigger 60 is pressed downwardly.

Moreover, the safety arrangement 70 further comprises a first holder 73 protruded from the pusher arm 711 and a second holder 74 protruded from the inner wall of the ignition trigger 60, wherein the first holder 73 and the second holder 74 are adapted to engage with two ends of the resilient element 72 respectively so as to securely hold the resilient element 72 between the pusher arm 711 and the inner wall of the ignition trigger 60. Accordingly, the first and second holders 73, 74, each having a rod-like shape, are adapted to insert into the two ends of the resilient element 72 respectively.

In order to ignite the barbecue lighter, the user must intentionally push the operation button 712 frontwardly so as to move the pusher arm 711 to a position that the bottom portion thereof is positioned aligning above the depressible end 42 of the gas lever 40, i.e. the ignition position of the barbecue lighter. At the same time, a downward force must be applied on the ignition trigger 60 to drive the pusher arm 711 downwardly so as to depress the depressible end 42 of the gas lever 40 for releasing gas. Therefore, the movable operating part 51 of the piezoelectric unit 50 is compressed to generate the sparks through the ignition tip 52 for igniting the emitted gas through the gas emitting nozzle 20.

After the barbecue lighter is ignited, the user may release the depressing of the ignition trigger 60 in such a manner that the compressed piezoelectric unit 50 will rebound to its original form which pushes the ignition trigger 60 upwardly back to the original position. Furthermore, the compressed resilient element 72 will then rebound rearwardly and force the pusher arm 711 to move away from the depressible end 42 of the gas lever 40 at its safety position.

Figure 4:
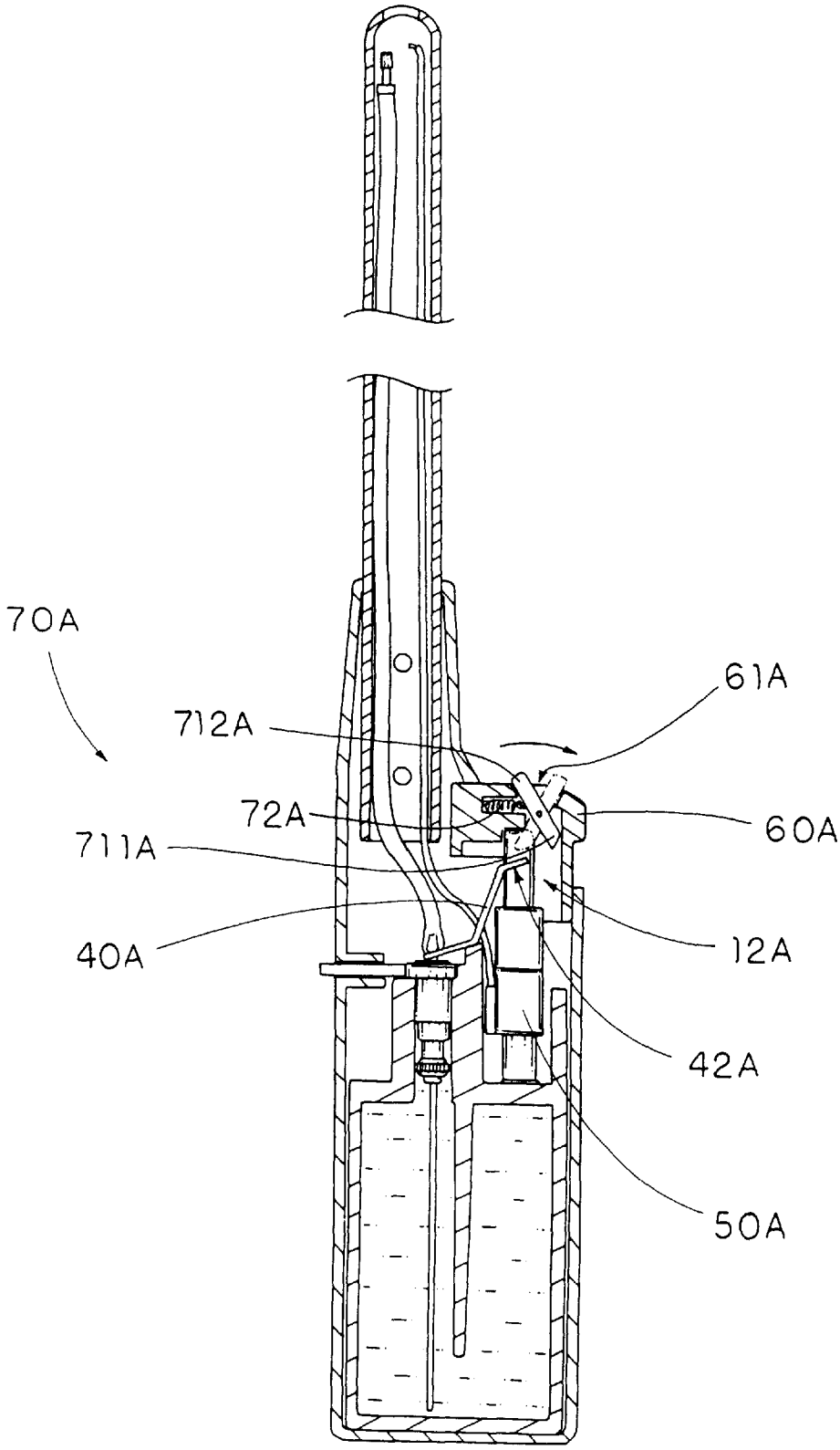
FIG. 4 illustrates an alternative mode of the safety arrangement of the barbecue lighter according to the above first preferred embodiment of the present invention.

FIG. 4 illustrates an alternative mode of the safety arrangement 70A wherein the pusher arm 711A is modified to pivotally mounted in the trigger cavity 12A by a pivot pin 701A in such a manner that the bottom portion of the pusher arm 711A is arranged to pivotally move to depress the depressible end 42A of the gas lever 40A at the ignition position.

As shown in FIG. 4, an upper portion of the pusher arm 711A is extended from the trigger cavity 12A to outside through the operation slot 61A wherein the upper portion of the pusher arm 711A functions as the operation button 712A to pivotally move the bottom portion of the pusher arm 711A from the safety position to the ignition position.

The resilient element 72A is disposed in the trigger cavity 12A for applying an urging pressure against the pusher arm 711A so as to normally retain the pusher arm 711A at the safety position. The resilient element 72A has two ends biasing against the pusher arm 711A and the inner wall of the ignition trigger 60A in such a manner that the resilient element 72A normally urges the pusher arm 711A to slightly rotate that the bottom portion of the pusher arm 711A is positioned away from the depressible end 42A of the gas lever 40A to prevent the gas released by the gas lever 40A when the ignition trigger 60A is pressed downwardly.

To ignite the barbecue lighter, the user must push the upper portion of the pusher arm 711A to pivotally move the bottom portion thereof at a position that right above the depressible end 42A of the gas lever 40A. Therefore, the downward movement of the ignition trigger 60A will drive the pusher arm 711A downwardly to depress the depressible end 42A of the gas lever 40A for releasing gas.

Figure 5:
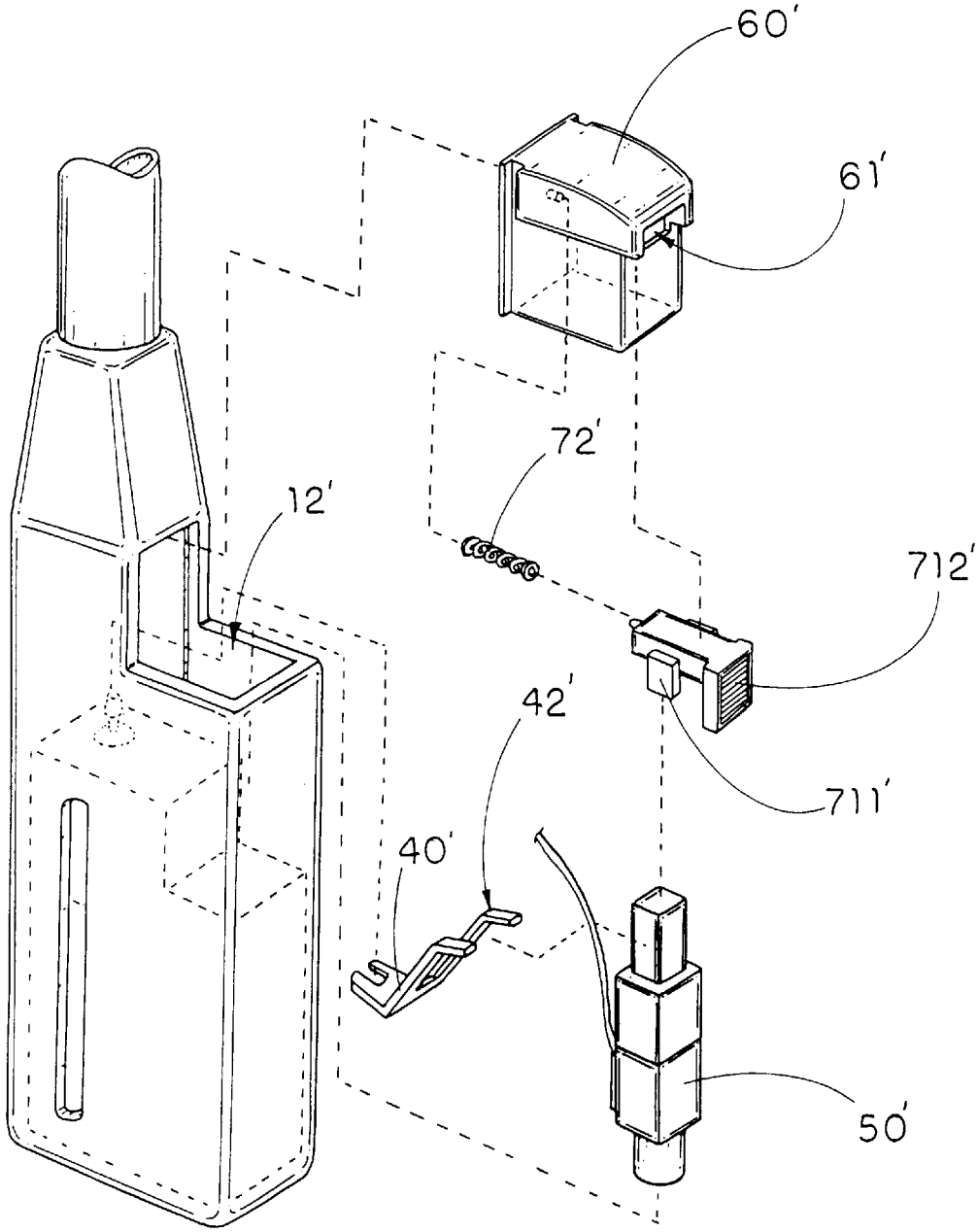
FIG. 5 is a partially exploded perspective view of a barbecue lighter with a safety arrangement according to a second preferred embodiment of the present invention.

Referring to FIG. 5, a second embodiment of the barbecue lighter is illustrated, which has a similar configuration as the above first embodiment. Basically, the barbecue lighter comprises identical components and structure as recited in the first embodiment except the operation slot 61' is provided on a rear wall of the ignition trigger 60' for communicating the trigger cavity 12' with outside in such a manner that the pusher arm 711' is frontwardly extended from the operation button 712' into the trigger cavity 12' through the operation slot 61'.

Figure 6:
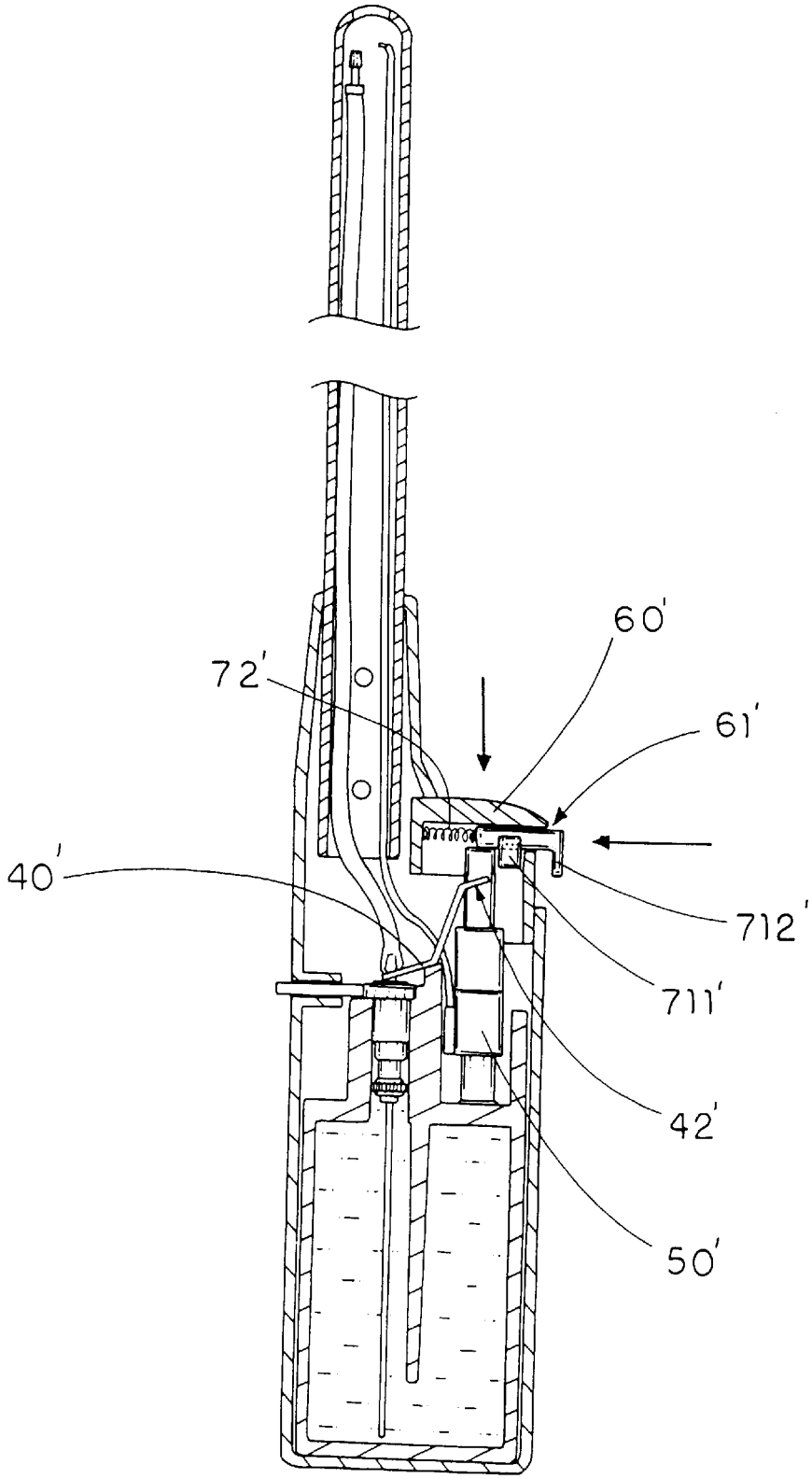
FIG. 6 is a sectional view of the safety arrangement of the barbecue lighter according to the above second preferred embodiment of the present invention.

Accordingly, a rear portion of the pusher arm 711' is extended out of the trigger cavity 12' through the operation slot 61' to form the operation button 712', wherein the rear portion of the pusher arm 711' is arranged to move a bottom portion thereof above the depressible end 42' of the gas lever 40' at the ignition position, as shown in FIG. 6.

In other words, the operation button 712', i.e. the rear portion of the pusher arm 711', is arranged to move the bottom portion of the pusher arm 711' from the safety position to the ignition position. At the safety position, the bottom portion of the pusher arm 711' is positioned away from the depressible end 42' of the gas lever 40' with a predetermined distance in such a manner that the depression of the ignition trigger 60' will not depress the depressible end 42' of the gas lever 40' by the pusher arm 711' so that the barbecue lighter will not be ignited.

In the ignition position, the pusher arm 711' is moved by the operation button 712' to a position that the bottom portion of the pusher arm 711' is positioned right above the depressible end 42' of the gas lever 40' in such a manner that when the ignition trigger 60' is depressed, the depression of the pusher arm 711' pushes the depressible end 42' of the gas lever 40' downwardly for releasing gas, so as to ignite the barbecue lighter.

The resilient element 72' is disposed in the trigger cavity 12' for applying an urging pressure against the pusher arm 711' so as to normally retain the pusher arm 711' at the safety position. As shown FIG. 5, the resilient element 72' is provided between the pusher arm 711' and an inner wall of the ignition trigger 60'. The resilient element 72' has two ends biasing against the pusher arm 711' and the inner wall of the ignition trigger 60' in such a manner that the resilient element 72' normally urges and retains the pusher arm 711' in a rearward position that the bottom portion of the pusher arm 711' is misalign with the depressible end 42' of the gas lever 40' to prevent the gas released by the gas lever 40' when the ignition trigger 60' is pressed downwardly.

To ignite the barbecue lighter, an inward force must be applied on the operation button 712' in order to push the pusher arm 711' inwardly while the bottom portion of the pusher arm 711' is positioned right above the depressible end 42' of the gas lever 40', i.e. the ignition position. Then, a downward force must be applied on the ignition trigger 60' to press the ignition trigger 60' downwardly to compress the piezoelectric unit 50' and depress the depressible end 42' of the gas lever 40' by the pusher arm 711' at the same time.

What is claimed is:

1. A barbecue lighter, comprising:

a casing having a liquefied gas cavity and a trigger cavity provided therein;

a gas emitting nozzle extended from and communicated with said liquefied gas cavity via a gas releasable valve;

an elongated nozzle tube mounting on a ceiling of said casing for encircling said gas emitting nozzle;

a gas lever, which is pivotally supported in said casing, having a lifting end engaged with said gas releasable valve and a depressible end arranged in such a manner that when said depressible end of said gas lever is depressed, said lifting end of said gas lever lifts up said gas releasable valve for releasing gas from said liquefied gas cavity;

a piezoelectric unit, which is disposed in said trigger cavity of said casing, having an ignition tip extended adjacent to said gas emitting nozzle;

an ignition trigger, which is disposed in said trigger cavity of said casing in a vertically movable manner, being attached on a top portion of said piezoelectric unit; and a safety arrangement, which comprises an actuating member comprising a pusher arm disposed in said trigger cavity in a movable manner, and a resilient element disposed between said pusher arm and said ignition trigger for applying an urging pressure against said pusher arm so as to normally retain said pusher arm in a safety position, wherein in said safety position, said pusher arm is positioned away from said depressible end of said gas lever with a predetermined distance, and in an ignition position, said pusher arm is moved to a position that when said ignition trigger is depressed downwardly, said pusher arm is driven downwardly to depress said depressible end of said gas lever for releasing gas, so as to ignite said barbecue lighter, wherein a bottom portion of said pusher arm functions as a pusher head, wherein in said ignition position, said pusher arm is moved to a position that said bottom portion thereof is positioned above said depressible end of said gas lever to depress said depressible end of said gas lever when said ignition trigger is depressed downwardly, wherein said actuating member further comprises an operation button extended from said pusher arm to outside through an operation slot provided on said ignition trigger in such a manner that said operation button is arranged to move said pusher arm from said safety position to said ignition position; wherein said pusher arm is pivotally mounted in said trigger cavity, wherein said resilient element has two ends biasing against said pusher arm and an inner wall of said ignition trigger in such a manner that said resilient element normally urges said pusher arm to slightly rotate that said bottom portion thereof is position away from said depressible end of said gas lever.

2. A barbecue lighter, comprising:

a casing having a liquefied gas cavity and a trigger cavity provided therein;

a gas emitting nozzle extended from and communicated with said liquefied gas cavity via a gas releasable valve;

an elongated nozzle tube mounting on a ceiling of said casing for encircling said gas emitting nozzle;

a gas lever, which is pivotally supported in said casing, having a lifting end engaged with said gas releasable valve and a depressible end arranged in such a manner that when said depressible end of said gas lever is depressed, said lifting end of said gas lever lifts up said gas releasable valve for releasing gas from said liquefied gas cavity;

a piezoelectric unit, which is disposed in said trigger cavity of said casing, having an ignition tip extended adjacent to said gas emitting nozzle;

an ignition trigger, which is disposed in said trigger cavity of said casing in a vertically movable manner, being attached on a top portion of said piezoelectric unit; and a safety arrangement, which comprises an actuating member comprising a pusher arm disposed in said trigger cavity in a movable manner, and a resilient element disposed between said pusher arm and said ignition trigger for applying an urging pressure against said pusher arm so as to normally retain said pusher arm in a safety position, wherein in said safety position, said pusher arm is positioned away from said depressible end of said gas lever with a predetermined distance, and in an ignition position, said pusher arm is moved to a position that when said ignition trigger is depressed downwardly, said pusher arm is driven downwardly to depress said depressible end of said gas lever for releasing gas, so as to ignite said barbecue lighter, wherein a bottom portion of said pusher arm functions as a pusher head, wherein in said ignition position, said pusher arm is moved to a position that said bottom portion thereof is positioned above said depressible end of said gas lever to depress said depressible end of said gas lever when said ignition trigger is depressed downwardly, wherein said actuating member further comprises an operation button extended from said pusher arm to outside through an operation slot provided on said ignition trigger in such a manner that said operation button is arranged to move said pusher arm from said safety position to said ignition position, wherein said operation slot is formed on a top wall of said ignition trigger such that said pusher arm is downwardly extended from said operation button into said trigger cavity through said operation slot, wherein said pusher arm is pivotally mounted in said trigger cavity, wherein said resilient element has two ends biasing against said pusher arm and an inner wall of said ignition trigger in such a manner that said resilient element normally urges said pusher arm to slightly rotate that said bottom portion thereof is position away from said depressible end of said gas lever.

3. A barbecue lighter, comprising:

a casing having a liquefied gas cavity and a trigger cavity provided therein;

a gas emitting nozzle extended from and communicated with said liquefied gas cavity via a gas releasable valve;

an elongated nozzle tube mounting on a ceiling of said casing for encircling said gas emitting nozzle;

a gas lever, which is pivotally supported in said casing, having a lifting end engaged with said gas releasable valve and a depressible end arranged in such a manner that when said depressible end of said gas lever is depressed, said lifting end of said gas lever lifts up said gas releasable valve for releasing gas from said liquefied gas cavity;

a piezoelectric unit, which is disposed in said trigger cavity of said casing, having an ignition tip extended adjacent to said gas emitting nozzle;

an ignition trigger, which is disposed in said trigger cavity of said casing in a vertically movable manner, being attached on a top portion of said piezoelectric unit; and a safety arrangement, which comprises an actuating member comprising a pusher arm disposed in said trigger cavity in a movable manner, and a resilient element disposed between said pusher arm and said ignition trigger for applying an urging pressure against said pusher arm so as to normally retain said pusher arm in a safety position, wherein in said safety position, said pusher arm is positioned away from said depressible end of said gas lever with a predetermined distance, and in an ignition position, said pusher arm is moved to a position that when said ignition trigger is depressed downwardly, said pusher arm is driven downwardly to depress said depressible end of said gas lever for releasing gas, so as to ignite said barbecue lighter, wherein a bottom portion of said pusher arm functions as a pusher head, wherein in said ignition position, said pusher arm is moved to a position that said bottom portion thereof is positioned above said depressible end of said gas lever to depress said depressible end of said gas lever when said ignition trigger is depressed downwardly, wherein said actuating member further comprises an operation button extended from said pusher arm to outside through an operation slot provided on said ignition trigger in such a manner that said operation button is arranged to move said pusher arm from said safety position to said ignition position, wherein said operation slot is formed on a top wall of said ignition trigger such that said pusher arm is downwardly extended from said operation button into said trigger cavity through said operation slot, wherein an upper portion of said pusher arm is extended out of said trigger cavity through said operation slot to form said operation button, wherein said upper portion of said pusher arm is arranged to move said bottom portion thereof above said depressible end of said gas lever, wherein said pusher arm is pivotally mounted in said trigger cavity, wherein said resilient element has two ends biasing against said pusher arm and an inner wall of said ignition trigger in such a manner that s aid resilient element normally urges said pusher arm to slightly rotate that said bottom portion thereof is position away from said depressible end of said gas lever.

4. A barbecue lighter, comprising:

a casing having a liquefied gas cavity and a trigger cavity provided therein;

a gas emitting nozzle extended from and communicated with said liquefied gas cavity via a gas releasable valve;

an elongated nozzle tube mounting on a ceiling of said casing for encircling said gas emitting nozzle;

a gas lever, which is pivotally supported in s aid casing, having a lifting end engaged with said gas releasable valve and a depressible end arranged in such a manner that when said depressible end of said gas lever is depressed, said lifting end of said gas lever lifts up said gas releasable valve for releasing gas from said liquefied gas cavity;

a piezoelectric unit, which is disposed in said trigger cavity of said casing, having an ignition tip extended adjacent to said gas emitting nozzle;

an ignition trigger, which is disposed in said trigger cavity of said casing in a vertically movable manner, being attached on a top portion of said piezoelectric unit; and a safety arrangement, which comprises an actuating member comprising a pusher arm disposed in said trigger cavity in a movable manner, and a resilient element disposed between said pusher arm and said ignition trigger for applying an urging pressure against said pusher arm so as to normally retain said pusher arm in a safety position, wherein in said safety position, said pusher arm is positioned away from said depressible end of said gas lever with a predetermined distance, and in an ignition position, said pusher arm is moved to a position that when said ignition trigger is depressed downwardly, said pusher arm is driven downwardly to depress said depressible end of said gas lever for releasing gas, so as to ignite said barbecue lighter, wherein said actuating member further comprises an operation button extended from said pusher arm to outside through an operation slot provided on said ignition trigger in such a manner that said operation button is arranged to move said pusher arm from said safety position to said ignition position, wherein said operation slot is formed on a rear wail of said ignition trigger such that said pusher arm is frontwardly extended from said operation button into said trigger cavity through said operation slot.

5. A barbecue lighter, as recited in claim 4, wherein a rear portion of said pusher arm is extended out of said trigger cavity through said operation slot to form said operation button, wherein said rear portion of said pusher arm is arranged to move said bottom portion thereof above said depressible end of said gas lever.

6. A barbecue lighter, comprising:

a casing having a liquefied gas cavity and a trigger cavity provided therein;

a gas emitting nozzle extended from and communicated with said liquefied gas cavity via a gas releasable valve;

an elongated nozzle tube mounting on a ceiling of said casing for encircling said gas emitting nozzle;

a gas lever, which is pivotally supported in said casing, having a lifting end engaged with said gas releasable valve and a depressible end arranged in such a manner that when said depressible end of said gas lever is depressed, said lifting end of said gas lever lifts up said gas releasable valve for releasing gas from said liquefied gas cavity;

a piezoelectric unit, which is disposed in said trigger cavity of said casing, having an ignition tip extended adjacent to said gas emitting nozzle;

an ignition trigger, which is disposed in said trigger cavity of said casing in a vertically movable manner, being attached on a top portion of said piezoelectric unit; and a safety arrangement, which comprises an actuating member comprising a pusher arm disposed in said trigger cavity in a movable manner, and a resilient element disposed between said pusher arm and said ignition trigger for applying an urging pressure against said pusher arm so as to normally retain said pusher arm in a safety position, wherein in said safety position, said pusher arm is positioned away from said depressible end of said gas lever with a predetermined distance, and in an ignition position, said pusher arm is moved to a position that when said ignition trigger is depressed downwardly, said pusher arm is driven downwardly to depress said depressible end of said gas lever for releasing gas, so as to ignite said barbecue lighter, wherein a bottom portion of said pusher arm functions as a pusher head, wherein in said ignition position, said pusher arm is moved to a position that said bottom portion thereof is positioned above said depressible end of said gas lever to depress said depressible end of said gas lever when said ignition trigger is depressed downwardly, wherein said actuating member further comprises an operation button extended from said pusher arm to outside through an operation slot provided on said ignition trigger in such a manner that said operation button is arranged to move said pusher arm from said safety position to said ignition position, wherein said operation slot is formed on a rear wall of said ignition trigger such that said pusher arm is frontwardly extended from said operation button into said trigger cavity through said operation slot.

7. A barbecue lighter, as recited in claim 6, wherein a rear portion of said pusher arm is extended out of said trigger cavity through said operation slot to form said operation button, wherein said rear portion of said pusher arm is arranged to move said bottom portion thereof above said depressible end of said gas lever.

8. A barbecue lighter, as recited in claim 6, wherein said resilient element has two ends biasing against said pusher arm and an inner wall of said trigger cavity to normally push said pusher arm rearwardly so as to move said bottom portion of said pusher away from said depressible end of said gas lever.

9. A barbecue lighter, as recited in claim 7, wherein said resilient element has two ends biasing against said pusher arm and an inner wall of said trigger cavity to normally push said pusher arm rearwardly so as to move said bottom portion of said pusher away from said depressible end of said gas lever.

* * * * *